United States Patent [19]

Condit

[11] 4,285,183

[45] Aug. 25, 1981

[54] WALLBOARD PATCHING APPARATUS

[76] Inventor: Ernest M. Condit, 5210 Reedley Pl., Castro Valley, Calif. 94546

[21] Appl. No.: 90,413

[22] Filed: Nov. 1, 1979

[51] Int. Cl.[3] ..... E04G 23/02

[52] U.S. Cl. ..... 52/514

[58] Field of Search ..... 52/514

[56] References Cited

U.S. PATENT DOCUMENTS

| | | | |
|---|---|---|---|
| 2,997,416 | 8/1961 | Helton | 52/514 X |
| 3,999,347 | 12/1976 | Devlin | 52/514 |
| 4,075,809 | 2/1978 | Sirkin | 52/514 |
| 4,100,712 | 7/1978 | Hyman | 52/514 |
| 4,193,243 | 3/1980 | Tiner | 52/514 |

*Primary Examiner*—Alfred C. Perham
*Attorney, Agent, or Firm*—Jack C. Munro

[57] ABSTRACT

A wallboard patching apparatus which takes the form of a thin sheet material, bendable base, the base including hiatus means in the form of a plurality of spaced-apart perforations. Centrally attached to the base and extending substantially perpendicular therefrom is a lock pin. The free end of the lock pin includes a hook. Adhesive is to be applied to the front operating face of the base adjacent the periphery thereof. The base is to be deformed and inserted through an opening in the wallboard. Once the base is extended through the wallboard, the lock pin is grasped and the now planar base is moved against the wallboard with the adhesive compressed between the front operating face and the inner surface of the wallboard. A wire bridge member is located between the hook of the lock pin and the exterior surface of the wallboard to fix the position of the base. The adhesive is then permitted to dry and after such has occurred, the bridge member and the lock pin are removed and the hole in the wallboard is then patched.

5 Claims, 4 Drawing Figures

Fig. 1
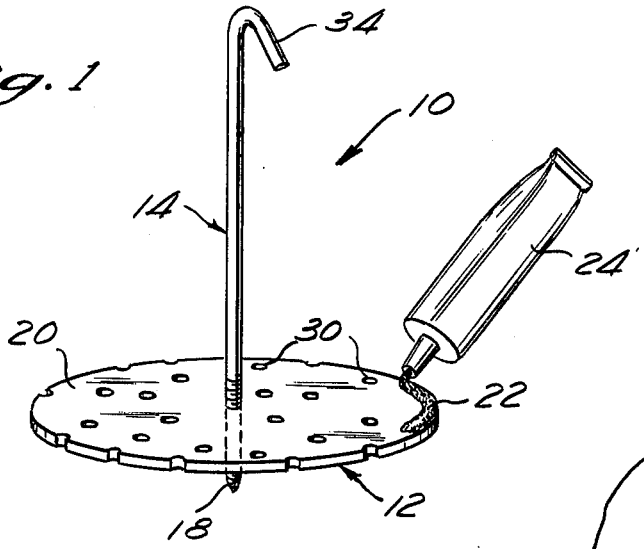
Fig. 2
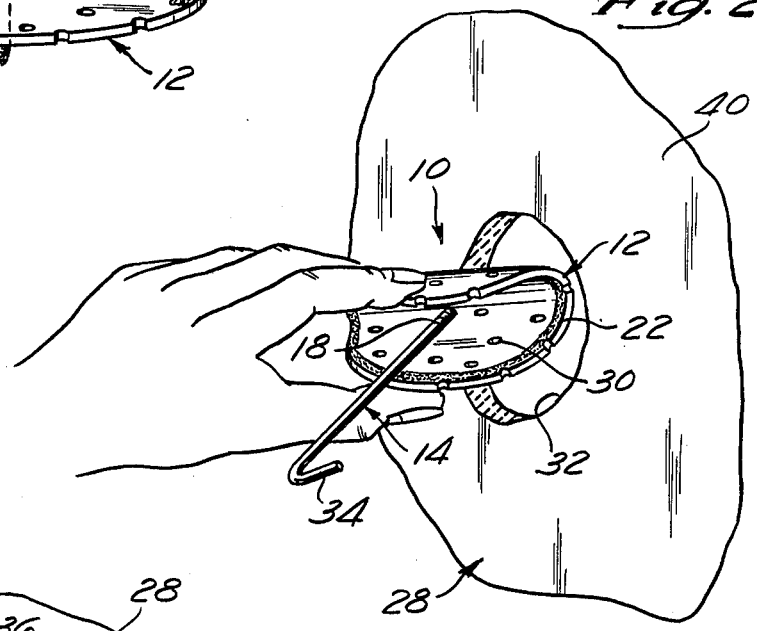
Fig. 3
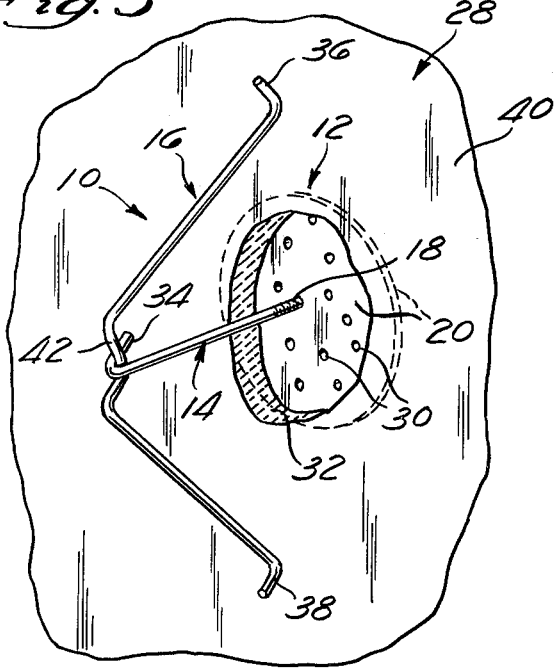
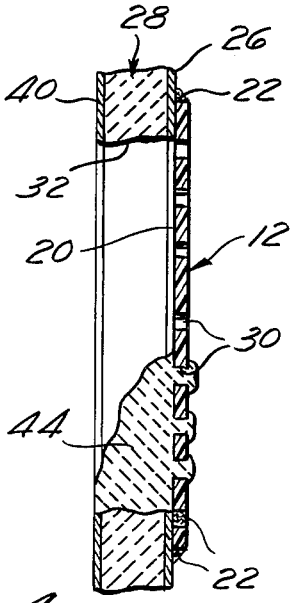
Fig. 4

WALLBOARD PATCHING APPARATUS

BACKGROUND OF THE INVENTION

At the present time, it is extremely common to employ the use of wallboard within homes, which forms the walls of the house. The wallboard is secured by means of a plurality of spaced-apart vertical wooden studs. This wallboard is constructed of an inner core of plaster composition which has on its outer surfaces thereof a thin, sheet material, paper layer. Once the wallboard has been installed, if for any reason a hole is accidentally knocked in the wallboard, such has been difficult to patch.

Once a hole has been punched through the wallboard, there is an enlarged opening to the inside of the hole so that any attempt to insert any kind of plaster or other patching substance within the hole results in that substance merely falling into the enlarged opening. Enterprising individuals in the past have attempted to fill the enlarged opening with crumpled newspaper, or the like, in an effort to finally provide some kind of support for the patching substance at the inner surface of the hole. The use of crumpled newspaper is not the most desirable method and does not readily facilitate the patching of such a hole.

In the past, there has been a definite need for an inexpensive wallboard patching kit which can be readily operated by even the most unskilled person to facilitate the patching of openings formed within wallboard. It is to be understood that although the structure of this invention is designed in particular to be employed in conjunction with wallboard, it is considered to be within the scope of this invention that this invention could be applied to any vertical sheet material structure wherein access to the rear of the hole is not provided and there is an enlarged opening to the rear of the hole. The structure of this invention could be employed with plaster walls.

SUMMARY OF THE INVENTION

The structure of this invention is summarily described in the Abstract of the Disclosure and reference is to be had thereto.

A primary objective of this invention is to construct a wallboard patching apparatus which can be quickly and easily operated by even the most unskilled person which provides for quick and easy patching of wallboard or other similar vertically disposed surfaces and which can be manufactured and marketed inexpensively.

BRIEF DESCRIPTION OF THE DRAWINGS

FIG. 1 is an isometric view of the base and its connected lock pin of the wallboard patching apparatus showing the application of adhesive to the base;

FIG. 2 is an isometric view showing the inserting of the base through an opening formed within a section of wallboard;

FIG. 3 is an isometric view showing the base being held in a fixed position by a bridge member mounted on the outer surface of the wallboard; and FIG. 4 is a cross-sectional view through the opening in the wallboard after drying of the adhesive and removal of the lock pin and the bridge member and depicting the patching of the opening within the wallboard with the base member being fixedly secured to the inner surface thereof.

DETAILED DESCRIPTION OF THE SHOWN EMBODIMENT

Referring particularly to the drawing, there is shown in FIG. 1 the wallboard patching apparatus 10 of this invention which is composed primarily of a base 12, a lock pin 14 and a bridge member 16. The base member 12 is shown to be circular but it is considered to be within the scope of this invention that other shaped configurations could be employed. The base member 12 is constructed of a plastic sheet material with polyethylene being preferable. This permits readily manual bending of the base 12 as is shown in FIG. 2 of the drawing.

The lock pin 14 includes a series of threads 18 at one end thereof. The treaded section 18 is sharply pointed at its outermost end. The person wishing to connect the lock pin 14 to the base 12 merely manually grasps the base 12 and forcibly screws the lock pin 14 into the base 12 at the approximate center point of the base. However, it is considered to be within the scope of this invention that it is not necessary to attach the lock pin 14 at the center point, such just being normally preferable.

Once the lock pin 14 is fixedly secured to the base 12, the operator is to then place a quantity of adhesive on the front operating face 20 of the base 12, adjacent the peripheral edge of the base 12. This adhesive 22 can be dispensed from a dispensing tube 24. The type of adhesive 22 is deemed to be optional and can comprise any type of adhesive which will adhere the base 20 to the interior surface 26 of the wallboard 28.

It has been found to be preferable to include some type of hiatus means within the base 12 so as to facilitate securing by the adhesive of the base 12 to the interior surface of the wallboard 28. A preferable type of hiatus means is a plurality of spaced-apart openings 30. Some of the openings 30 adjacent the peripheral edge of the base 12 will receive adhesive and upon the adhesive drying, will function like rivets or nails between the inner surface 26 of the wallboard and the base 12. This tends to fixedly secure the base to the wallboard 28 so that the base 12 will function as a solid support surface for the rear of the hole 32 formed within the wallboard 28.

Once the adhesive 22 has been applied to the front operating face 20 of the base 12, the base 12 is then deformed so as to be insertable through the hole 32. This is depicted within FIG. 2 of the drawing. Once the base 12 is located interiorly of the hole 32, the base 12 is then released and permitted to assume its at-rest, planar configuration, shown within FIG. 1. The operator at this particular time has hold of the lock pin 14. It is to be noted that the free end of the lock pin 14 is formed into a hook 34. A preferable material of construction for the lock pin 14 would be a wire rod.

A basically trianguarly shaped bridge member 16 includes flared outer ends 36 and 38 which are to be located against the exterior surface 40 of the wallboard 28. The apex of the bridge member 16 is formed into an indention 42. The hook member 34 is to be located within the indention 42 and then the flared ends 36 and 38 of the bridge member 16 are to be located against the exterior surface 40 of the wallboard 28. The bridge member 16 is to be manually manipulated until it assumes a substantially perpendicular location with respect to the wallboard 28 and substantially in line with the lock pin 14. The bridge member is then left unattended for a period of time until the adhesive 22 has dried. The operator then manually removes the bridge member 16 and unscrews the lock pin 14 from the base 12. Because the adhesive is dry, the base 12 remains in position. The operator can then patch the hole 32 with some type of patching composition, such as patching plaster 44 or the like.

What is claimed is:

1. A wallboard patching apparatus comprising:

a sheet material base having a front operating face, said base being bendable to assume a substantially smaller size, when at rest said base assuming a substantially planar configuration, said front operating face of said base to receive a quantity of an adhesive adjacent the peripheral edge of said front operating face;

a lock pin removably attached to said base at said front operating face, said lock pin extending outwardly from said front operating face, the free end of said lock pin having a connecting means in the form of a hook;

a bridge member to connect with said connecting means, said bridge member comprising a substantially triangularly shaped wire rod, the apex of said wire rod including means to facilitate connecting to said hook, the outer ends of said bridge member to press against the wallboard which causes an outward force being applied to said lock pin which tightly holds said sheet material base in contact with the wallboard; and whereby said base with said adhesive applied and with the lock pin connected is to be deformed and inserted entirely through a hole in the wallboard, the base is then to be released and pressed against the inside wall surface of the wallboard with the adhesive located therebetween, the bridge member is then located between the outside surface of the wallboard and the connecting means to fix the location of the base, this situation is maintained until the adhesive dries, then the bridge member and lock pin are removed, the hole in the wallboard is now readily patchable with plaster or the like.

2. The apparatus as defined in claim 1 including:

said base including a hiatus means, said hiatus means to facilitate the securing of said base to the wallboard by the adhesive.

3. The wallboard patching apparatus as defined in claim 2 wherein:

said hiatus means comprising a plurality of spaced-apart perforations.

4. The wallboard patching apparatus as defined in claim 1 wherein:

said lock pin being connected at the approximate center of said base, said lock pin extending from said base at substantially a right angle.

5. The wallboard patching apparatus as defined in claim 4 wherein:

said lock pin being screw-threadingly connected to said base.

* * * * *